US005338262A

United States Patent [19]

Hayes

[11] Patent Number: 5,338,262

[45] Date of Patent: Aug. 16, 1994

[54] CUE BALL ANGLE DETERMINATOR

[76] Inventor: Lloyd M. Hayes, Rte. 1, Box 134, Proctorville, Ohio 45669

[21] Appl. No.: 96,266

[22] Filed: Jul. 26, 1993

[51] Int. Cl.[5] ..... A63D 15/08

[52] U.S. Cl. ..... 473/2

[58] Field of Search ..... 273/2, 14

[56] References Cited

U.S. PATENT DOCUMENTS

| | | | |
|---|---|---|---|
| 2,537,228 | 1/1951 | Matson | 473/2 |
| 3,220,122 | 11/1965 | Miller | 273/14 |
| 3,299,537 | 1/1967 | Franks | 273/14 |
| 3,411,779 | 11/1968 | McGowan | 273/2 |
| 3,463,593 | 8/1969 | Horan | 273/14 |
| 4,027,883 | 6/1977 | Batori | 473/2 |
| 4,082,270 | 4/1978 | Josenhans | 473/2 |
| 4,151,990 | 5/1979 | Josenhans | 473/2 |
| 4,178,694 | 12/1979 | Bonney | 273/14 |
| 4,882,676 | 11/1989 | Van De Kop | 273/14 |
| 5,125,652 | 6/1992 | Davis | 223/2 |
| 5,154,415 | 10/1992 | Zotos | 473/2 |
| 5,275,398 | 1/1994 | Compton | 473/2 |

*Primary Examiner*—Theatrice Brown

[57] ABSTRACT

The cue ball angle determinator is a small device to be used while playing the game games of pool, billiards or snooker. The purpose of the invention is to determine the exact spot on the rail cushion to strike in order to make an accurate path of travel of the cue ball. This has been accomplished with the cue ball angle determinator by means of adjustable indicators to direct beams of light to the intended balls of action and a marker to mark the point of impact on the rail cushion after this has been established.

8 Claims, 2 Drawing Sheets

CUE BALL ANGLE DETERMINATOR

FIELD OF INVENTION

The invention relates to the aiming devices as used in playing the games of "BILLIARDS", "SNOOKER" and "POOL", and more precisely , to the "CUE BALL ANGLE DETERMINATOR", which is a training aid to help players achieve an excellence for playing the games.

BACKGROUND OF THE INVENTION

The games of "BILLIARDS", "SNOOKER" and "POOL", are played on a "POOL TABLE", using a series of balls and a cue ball, which is used to strike another ball in order to drive it into a pocket or strike another ball. Sometimes it is necessary to rebound the cue ball off the rail cushion in order to strike another ball correctly so as to direct it in the proper direction. This is known as a bank shot. Since it is well known that a cue ball will leave the cushion at exactly the same angle that cue ball struck the cushion, the difficulty arises as to where to strike the rail cushion so as to make it travel in the proper direction to strike the target ball at the correct spot. This has been achieved in the past by experience and mental calculations, which have proven to be somewhat inaccurate. Thus is the intention of my invention, a simple device to accurately and quickly pinpoint the exact spot on the rail cushion to strike with the cue ball so to rebound it in the proper direction to strike the target ball correctly.

DESCRIPTION OF THE PRIOR ARTS

Numerous prior art devices have been devised to aid a player to improve his skill in shooting pool. The following devices are described in U.S. Pat. No. 5,154,415 (ZOTOS) used to determine the rebound point of the cue ball by means of a protractor device with strings attached that are to be stretched to the intended balls of play and anchored in place with weights. The protractor type device is then slid along the rail cushion until the strings intersect the protractor at the same angle. While this somewhat seems to solve the problem, it also seems to be a bit cumbersome to set up and remove before shooting the ball.

Another device using mirrors placed under the rail cushion is described in U.S. Pat. No. 4,531,732 (HARRIS). This involves mirrors placed under the rail cushion and adjusted by means of a device placed on the end of a cue stick so as to make it convenient for viewing at the desired angle. While this may make the mirrors convenient for viewing at the desired angle, it still does not indicate the exact spot on the rail cushion to strike with the cue ball in order to make an intended shot. It also suggests using a mirror under each rail cushion to take full advantage of its intended purpose. This seems to be a bit cumbersome for the results obtained.

Another device described in U.S. Pat. No. 4,882,676 which is a laser controlled device and appears to be a game within itself and does not seem to have any bearing on devices designed to predict the path of travel of a ball that has been rebounded off the rail cushion.

Yet another device described in U.S. Pat. No. 4,178,694 involves a device for determining the point of contact of a cue ball to strike another ball to propel it the path of predetermined travel. This is known as an off center shot and does relate to bank shots as such.

The optimum device would correctly predict the line of travel of a cue ball after it has struck the rail cushion so as to strike the target ball at the intended spot and to pinpoint and mark the striking point on the rail cushion to achieve this. The device should be small, light, portable and inexpensive. It should also be highly accurate and not require a lot of scientific knowledge to use. This is what I have attempted to do with the "CUE BALL ANGLE DETERMINATOR".

SUMMARY OF THE PRESENT INVENTION

The objective of this invention is to be able to pinpoint the correct place on the rail cushion of a pool table, in order to correctly rebound the cue ball to strike another ball so as to make it travel in a desired direction. The best of pool players can only hope for mediocre success in trying to mentally ascertain the correct spot for rebounding the cue ball so as to make it travel in a desired direction. With the cue ball angle determinator, it becomes a matter of seconds to perform this feat with great accuracy. The cue ball angle determinator is very light weight, compact, and very inexpensive. It consists of a small rectangular device with a overhanging ledge for the purpose of aligning it with the playing surface of the pool table. It has two rotating cylinders with indicating tubes attached which are rotated by means of an adjustment arm that rotates the cylinders in opposite directions while projecting a beam of light horizontally toward the balls of play through the indicating tubes. The adjusting slide is used to manipulate the light beams toward the intended balls of action by sliding the unit along the rail while as the beams of light are being finely directed toward the intended balls. After the indicator lights have been adjusted to the correct position, the marking unit is depressed to leave a small chalk mark at the correct striking point on the rail cushion. The unit is removed from the rail cushion and play is resumed.

DESCRIPTION OF THE PREFERRED EMBODIMENTS

Figure 1:
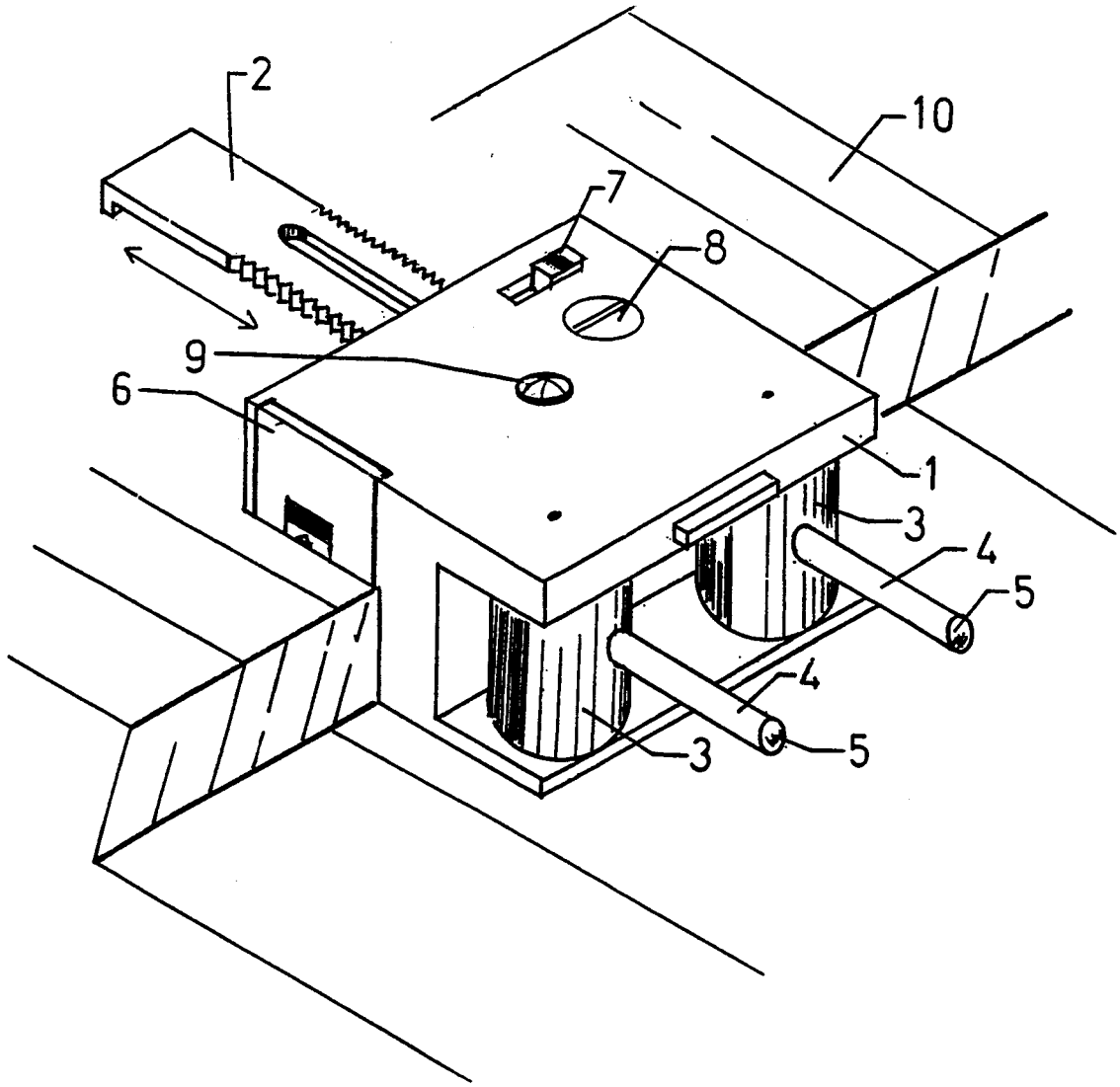
FIG.1 shows an overhead isometric view of the cue ball angle determinator as it will appear correctly set up for use on the pool table. It also shows all the external parts involved.
Figure 2:
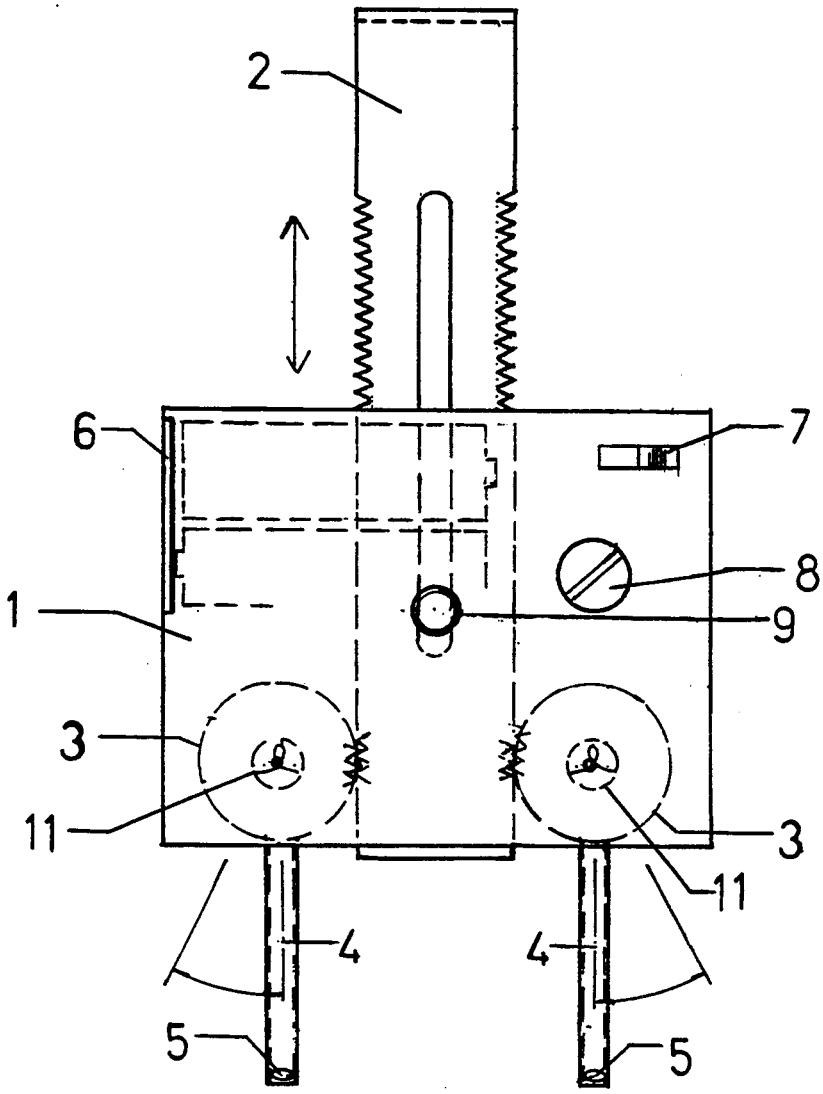
FIG.2 is an overhead plan view of the cue ball angle determinator as it is placed against the rail cushion ready for use and also shows all the external parts involved.
Figure 3:
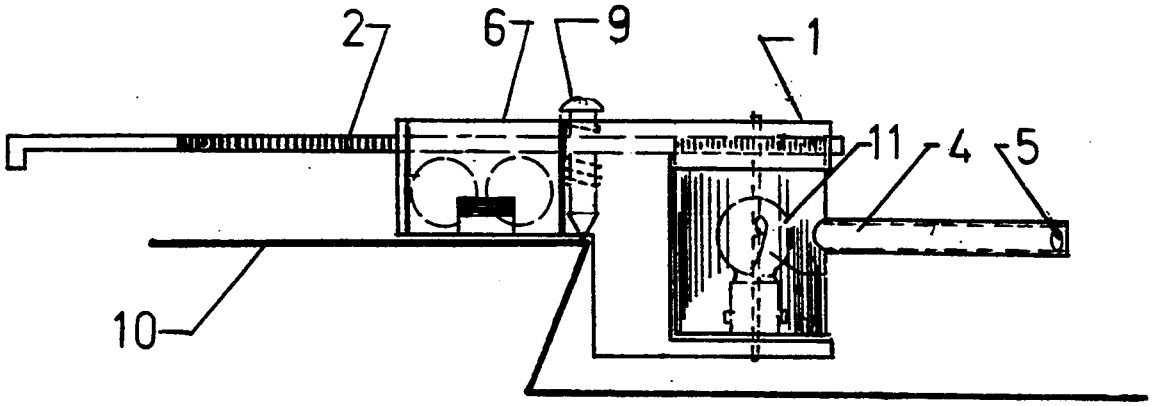
FIG.3 is a sectional view from front to back, showing the internal parts as it is in place against the rail cushion.

The cue ball angle determinator #1, consists of a rectangular device with a ledge to overhang the rail cushion #10, to align it with the playing surface of the pool table. The adjustment slide #2, which has gear teeth on each edge, fits between the indicator cylinders #3, which has gear teeth #12, around the top edge of the cylinders and is rotated in opposite directions as the adjustment slide #2, is moved forward or backward. A light is emitted through indicator tubes #4, which has colored lens #5, to distinguish the light being emitted from ordinary room illumination. The batteries #6, are used to power the incandescent/laser beams being emitted. The switch #7, is used to turn the lights in the rotating units on or off. The chalk reservoir #8, is where chalk powder is stored for the marking unit. The marking unit #9, is used to mark the exact spot on the rail cushion to strike with the cue ball in order to make a correct shot. The marker is operated under spring pressure #13, to return the marker to the original position.

The entire cue ball angle determinator should be made from a hard plastic or die cast with a zinc alloy known as "pot metal". The electrical circuitry would use conventional electrical components such as brass contacts, stranded electrical wire and incandescent-/laser units as are presently manufactured by several companies.

I claim:

1. A cue ball bank shot angle determinator comprising:

a housing having front and back walls, left and right walls, and substantially planar top and bottom walls; said front wall having defined therein a substantially U-shaped recess, a and said rear wall having defined therein a substantially L-shaped recess, whereby one leg of said L-shaped recess is adapted to engage the top surface of a pool table rail and the other leg of the L-shaped recess is adapted to engage the inner surface of the pool table rail;

a pair of hollow cylinder members; said cylinder members having a longitudinal axis and being mounted in said U-shaped recess for rotation about said longitudinal axis, said cylinder members further being spaced apart a predetermined distance;

an adjustment means, said adjustment means being movably mounted in said housing and between said cylinder members;

means on said adjustment means for engaging means on each of said cylinder members to cause simultaneous rotation of said cylinder members in opposite directions when said adjustment means is moved;

light emitting means in each of said cylinder members and means on each of said cylinder members and in communication with the interior thereof for directing emitted light in a predetermined direction and a predetermined distance above a pool table playing surface;

means for energizing said light emitting means and means connecting said means for energizing to said light emitting means; and means on said housing for producing a mark on a pool table rail.

2. The apparatus as defined in claim 1, wherein said adjustment means is an elongated member extending through complementary openings in said front and rear walls; and means in said adjustment means and said means on each of said cylinder members are gear teeth.

3. The apparatus as defined in claim 2, wherein said light emitting means is an incandescent lamp.

4. The apparatus as defined in claim 2, wherein said light emitting means is a laser.

5. The apparatus as defined in claims 3 or 4, wherein said means for energizing said light emitting means is a battery.

6. The apparatus as defined in claim 1, wherein said means for directing said emitted light is an elongated tubular member, said tubular member having a colored lens.

7. The apparatus as defined in claim 1, wherein said means connecting said means for energizing to said light emitting means is an electric circuit, said electric having switch means for activation and deactivating said electric circuit.

8. The apparatus as defined in claim 1, wherein said means for providing a mark is a spring biased plunger extending through an opening in said one leg of said L-shaped recess, and a reservoir in said housing for holding a powder; said opening being in communication with said reservoir such that when said plunger is depressed a powder is dispensed upon a pool table rail, thus providing a mark at which a pool ball is propelled.

* * * * *